United States Patent [19]

Klever et al.

[11] Patent Number: 4,571,861

[45] Date of Patent: Feb. 25, 1986

[54] BULLDOZING OR SNOWPLOW BLADE

[75] Inventors: Manfred Klever; Karl-Heinz Rott, both of Saarbruecken, Fed. Rep. of Germany

[73] Assignee: Gutbrod-Werke GmbH, Saarbruecken-Buebingen, Fed. Rep. of Germany

[21] Appl. No.: 589,705

[22] Filed: Mar. 15, 1984

[30] Foreign Application Priority Data

Mar. 19, 1983 [DE] Fed. Rep. of Germany ..... 3310062

[51] Int. Cl.[4] ..... E01H 5/00

[52] U.S. Cl. ..... 37/241; 111/34; 172/701.1; 222/485

[58] Field of Search ..... 37/232, 241, 261; 172/701.1, 701.3, 811, 747; 111/1, 9, 34; 222/625, 608, 480, 561, 485

[56] References Cited

U.S. PATENT DOCUMENTS

| | | | |
|---|---|---|---|
| 2,440,905 | 5/1948 | Maxim et al. | 37/232 X |
| 2,927,385 | 3/1960 | Blomquist | 172/811 X |
| 2,997,796 | 8/1961 | Pogue et al. | 37/241 X |
| 3,121,964 | 2/1964 | Cobb | 172/701.1 X |
| 3,230,645 | 1/1966 | Lutz | 37/232 X |
| 3,987,562 | 10/1976 | Deen et al. | 37/232 X |

FOREIGN PATENT DOCUMENTS

| | | | |
|---|---|---|---|
| 274439 | 8/1966 | Australia | 222/625 |

*Primary Examiner*—Edgar S. Burr
*Assistant Examiner*—Moshe I. Cohen
*Attorney, Agent, or Firm*—W. G. Fasse; D. H. Kane, Jr.

[57] ABSTRACT

A clearing blade, as an attachment for a garden tractor or the like, is constructed as a double-walled construction thereby forming a box-like spreading funnel (5) between the wall members so that simultaneously with or after clearing snow, salt or other granular material may be spread by the same implement used for the clearing. Due to the rigid box-structure of the blade a sufficient strength is obtained even by materials of lesser strength than expensive, fracture resistant steels. Hence, such materials of lesser strength, e.g., synthetic materials, may be used for manufacturing the present blade by an injection molding or die-casting method.

11 Claims, 2 Drawing Figures

BULLDOZING OR SNOWPLOW BLADE

FIELD OF THE INVENTION

Figure 2:
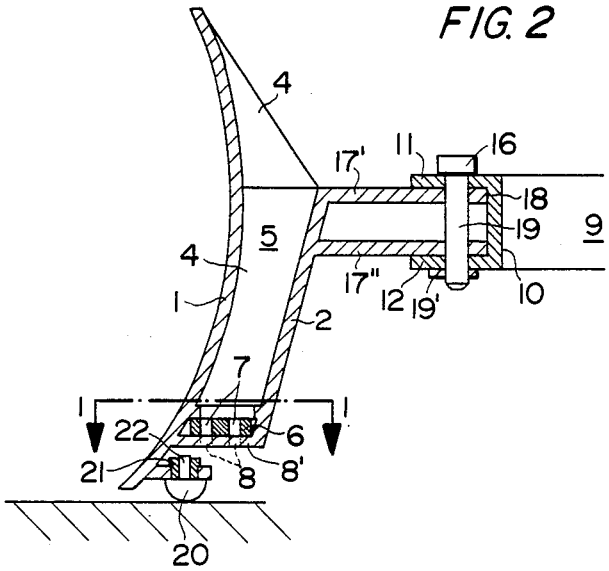

The invention relates to a clearing blade, for example for a bulldozing or snowplowing operation, and forming an attachment for a motorized vehicle or device. Such blades are especially suitable for a hand guided motorized device, for example, a garden tiller or for a garden tractor for clearing snow.

DESCRIPTION OF THE PRIOR ART

Detachable blades of the kind described above are known in the art. Such blades are made of steel and hence frequently are so heavy that their attachment to and removal from a vehicle or other motorized device is hard work often requiring a hydraulic lift or the like to do the job. Thus, it is not uncommon to leave these blades attached to the respective vehicle or drive device thereby limiting the usefulness of the vehicle or device for other purposes.

On the other hand, the need for clearing sidewalks, paths, streets, and squares of snow does not arise every year in the moderate zone, and mostly not at regular time intervals. Thus, it should not seem surprising that caretakers of park, sport, or garden grounds or similar establishments, which often are subject to public or communal administration, do not have such an attachment available when it is needed. Such unavailability is also due to the fact that prior art blades are relatively expensive, so that they are considered, though unjustifiably, as inappropriate attachments which one can do without.

OBJECTS OF THE INVENTION

In view of the above it is the aim of the invention to achieve the following objects singly or in combination:

to construct a clearing blade such as a snowplow blade so that it may be produced at a lower cost for materials and man hours than previously, and that nonetheless is sufficient for all demands in practice, with respect to ease and simplicity of operation, as well as effectiveness of use;

to construct the blade so that due to its reinforcement it may be made of a suitable synthetic material by injection molding or the like; and to combine the clearing blade with a device for spreading granular material. SUMMARY OF THE INVENTION According to the invention, a clearing blade of the above mentioned type comprises a double-walled construction in the area of power application, whereby the walls are preferably arranged as a box-shaped spreading funnel, which forms a structural unit with the blade proper and increases the rigidity. This construction substantially increases the rigidity of the complete structural unit. An additional benefit is seen in that the blade, when used for snow removal, may also be used for the simultaneous or subsequent spreading of salt, sand, or other granular material. When grading a garden or lawn plot the blade may also be used for spreading seeds or fertilizer.

In a preferred embodiment the present blade/box unit is formed as a one piece integral unit manufactured by injection molding or die-casting. As a result, materials less expensive than steel may be used for the manufacture of the present blades.

A further feature of the invention is seen in that the blade body, produced by an injection molding or die-casting method, is equipped with hooks, pockets, brackets, or the like, for holding ballast weights. The use of such weights, for example in the form of concrete blocks is advantageous if the structural unit is not manufactured of steel or metal alloys, so that its own weight may be so small, that it becomes necessary to load it with ballast weights in order to achieve a smooth operation.

The box of the blade constructed as a spreading funnel is preferably provided with spreading holes in its floor and a closure member such as a slide closes or opens the holes. Thus, in the winter the plow blade may be used to clear snow away from paths or the like, and thereafter it may be used to spread a spreading material over the cleared surface, or if the closure member or slide is open, the material may be spread simultaneously wth the snow clearing.

BRIEF FIGURE DESCRIPTION

Figure 1:
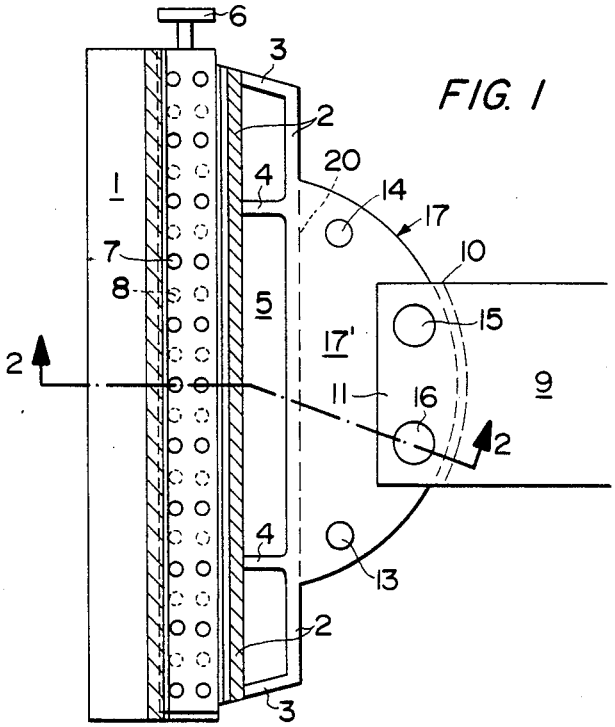

In order that the invention may be clearly understood, it will now be described, by way of example, with reference to the accompanying drawings, wherein:

FIG. 1 is a top plan view, partially in section, as viewed from the position of line 1—1 in FIG. 2; and FIG. 2 is a sectional view, as viewed from the position of line 2—2 in FIG. 1.

DETAILED DESCRIPTION OF PREFERRED EXAMPLE EMBODIMENTS AND OF THE BEST MODE OF THE INVENTION

The front clearing blade surface 1 or blade proper in the shape of a segment cut out of the wall of a hollow cylinder, forms a double-walled construction with the rear wall 2 forming a blade reinforcing wall member. Both walls are connected to each other by appropriately dimensioned cross members 3, 4 forming strengthening ribs. In this manner, the space between the clearing blade 1 and the rear wall 2 forms a box 5, for receiving spreading material or ballast means. The spreading material flows onto the cleared surface through the openings or holes 7 which may be closed by a slide member 6. The holes 7 are in the slide member 6. The holes 8 are in the floor or bottom wall 8' of the box 5. By sliding the slide member 6 into the open position the holes 7 and 8 are brought into register or alignment for the spreading. When the slide member 6 is in the closed position the holes 7 and 8 do not register.

A tractor or motorized device, such as a tiller, not shown, is provided with a hitching bar 9 for mounting the blade 1, 2. This mounting or connection is achieved with the aid of a circular arc-shaped U-rail 10, which is attached to the front of the hitching bar 9. The U-rail 10 has leg plates 11, 12 (FIG. 2) provided with two pairs of holes spaced for cooperation and alignment with the holes 13, 14 in the hitching segment 17, extending rearwardly from the box 5. These bored holes in the U-rail leg plates 11, 12 are not visible in FIG. 1 because they are hidden by the heads 15, 16 of the bolts 19 which pass through these bores in the leg plates 11, 12 of the U-rail 10 and through the respective aligned holes in the hitching segment 17.

The transmission of thrust from the hitching bar 9 to the blade 1, 2 is not achieved at a single-point bolt and eye as in known arrangements, rather it is achieved over the circular arc-shaped U-rail 10 of the hitching bar 9 bearing against the edges or rims 18 of the segment-like attachment or hitching segment 17 which bears against the blade structure along a chord 20, thereby distributing the thrust over a substantial surface portion of the blade structure. The two bolts first serve in the centering and securing the parts to be coupled, and only secondarily in the thrust transmission, because the edges of the hitching segment 17 or rather, of the two hitching plates 17' and 17" bear against the curved U-rail 10.

A circular segment-shaped attachment or hitching segment 17 formed by said two hitching plates 17', 17" is rigidly attached to the back wall 2 and reaches with its circular arc-shaped rim 18 between the leg plates 11, 12 of the U-rail 10. The holes 13, 14 are provided in the rim area 18 and extend through both hitching plates at the at four angular positions. These holes match in pairs with the hole locations in the leg plates 11, 12 and covered by the bolt heads 15, 16. Since the spacing between the bored holes in the leg plates 11, 12 of the U-rail 10 and the angular spacings between the holes 13, 14 in the rim area 18 of the attachment element or segment 17 are the same, the connection between the hitching bar 9 and the blade 1, 2 may be made in a centered middle position or in a tilted position to either side, as desired.

Skid shoes 20, which are attached to the lower edge of the front blade surface 1, rest on the ground and guide the lower blade edge closely above the surface to be cleared. The height of these skid shoes 20 may be adjusted by means of a simple plug-in connection. Studs 22 on the foot of the skid shoe 20 are simply inserted into lug eyes 21 located on the backside of the blade surface 1. The studs 22 are made so as to be self-locking when they are pressed into the lug eyes 21. Incidentally, the bolts 19 may be secured against withdrawal by a cotter pin 19'.

A certain freedom of movement of the blade structure in the vertical direction relative to the hitching bar 9 which is, for instance, necessary when using a two-axled motorized device, in order to overcome irregularities in the ground, may be achieved in that the spacing between the hitching plates 17', 17" of the segment-like attachment 17 is less than the distance between the leg plates 11, 12 of the U-shaped rail 10.

Incidentally, materials suitable for injection molding the blade structure are, for example, metal and/or plastic material.

Although the invention has been described with reference to specific example embodiments, it will be appreciated that it is intended to cover all modifications and equivalents within the scope of the appended claims.

What is claimed is:

1. A snow clearing blade construction as an attachment for a motorized device, comprising a snow clearing blade member (1) having a given horizontal blade length, a blade reinforcing wall member (2) having a horizontal wall length corresponding substantially to said given blade length, means including side walls operatively connecting said reinforcing member to the rear of said snow clearing blade member with a spacing between said clearing blade member and said reinforcing wall member, said snow clearing blade member and said wall member forming a double-walled upwardly open container corresponding in length substantially to said given horizontal blade length for increasing the rigidity in an area of power application to said clearing blade construction, a bottom wall closing said double-walled container downwardly, holes in said bottom wall for using said double-walled container as a spreader for granular material, a closure member (6) arranged for cooperation with said bottom wall for temporarily closing said holes in said bottom wall, and wherein said double-walled container is an injection molded one-piece integral structural unit forming a spreading funnel into which said granular material can be filled from the top for spreading downwardly directly behind said snow clearing blade member, substantially over its entire horizontal blade length.

2. The clearing blade of claim 1, further comprising strengthening ribs (4) reaching from a top edge of the clearing blade member to said blade reinforcing wall member.

3. The clearing blade of claim 1, wherein said double walled container is made of a cold temperature resistant synthetic material.

4. The clearing blade of claim 1, further comprising means for holding ballast weights.

5. The clearing blade of claim 1, wherein said closure member (6) for said bottom wall comprises a slide member with holes therein which register with said holes in said bottom wall when said slide member is in its granular material spreading position, said slide member closing said holes in said bottom wall when the slide member is in a hole closing position.

6. The clearing blade of claim 1, further comprising segment shaped attachment means (17) rigidly secured to said double-walled container on its side facing the motorized device, said attachment means having a circular arc-shaped edge (18) comprising equally spaced, equally dimensioned holes (13, 14) for receiving attachment bolt means (19) of a motorized device (9), said attachment means (17) further comprising a chord section rigidly attached to the double-walled construction.

7. The clearing blade of claim 6, wherein said arc-shaped edge of said attachment means (17) comprises four holes for receiving bolt means for attaching the blade to a motorized device (9); one hole being located at each of the locations left of center, right of center, left outside, and right outside.

8. The clearing blade of claim 6, wherein said segment shaped attachment means comprise two substantially semi-circular plates extending in parallel to each other at a predetermined spacing adapted to receive a hitching member of said motorized device, said holes extending in vertical alignment through both plates, so that the holes forming a pair are vertically aligned with each other.

9. The clearing blade of claim 1, further comprising skid shoe means (20) attached to the bottom edge of said clearing blade construction, and plug-in connection means operatively securing said skid shoe means to said clearing blade construction.

10. The clearing blade of claim 9, wherein said plug-in connection means are self-locking for preventing unintended removal of said skid shoe means.

11. The clearing blade of claim 9, wherein said skid shoe means are made of wear resistant and cold resistant synthetic material.

* * * * *